US005978007A

United States Patent [19]

Sawano et al.

[11] Patent Number: 5,978,007

[45] **Date of Patent: *Nov. 2, 1999**

[54] THERMAL HEAD

[75] Inventors: Mitsuru Sawano; Kazuaki Kinjyo, both of Shizuoka-ken, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/883,436

[22] Filed: Jun. 26, 1997

[30] Foreign Application Priority Data

Jul. 8, 1996 [JP] Japan ..... 8-178029

[51] Int. Cl.[6] ..... B41J 2/335

[52] U.S. Cl. ..... 347/202

[58] Field of Search ..... 347/202, 204, 347/206; 2/325, 335

[56] References Cited

U.S. PATENT DOCUMENTS

| | | | |
|---|---|---|---|
| 4,707,708 | 11/1987 | Kitagishi et al. | 347/202 |
| 4,742,362 | 5/1988 | Takoshima et al. | 347/202 |
| 4,840,500 | 6/1989 | Sasaki et al. | 347/202 |
| 5,267,005 | 11/1993 | Yamamoto | 355/290 |

FOREIGN PATENT DOCUMENTS

| | | | |
|---|---|---|---|
| 07117359 | 5/1995 | Japan | B41M 5/30 |
| 07132678 | 5/1995 | Japan | B41M 5/26 |

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

A thermal head, in which the catching of a foreign object on a partial glaze is prevented and the head pressure of the partial glaze is not reduced, is provided such that the image quality is improved by preventing the occurrences of line voids, irregularities, and roughness. In a thermal head which includes a partial glaze, which protrudes and whose cross-sectional configuration is substantially arc-shaped, on a recording material opposing surface, the radius of curvature of a heater portion on the partial glaze is less than 50 mm and the height of the partial glaze from the recording material opposing surface is 40 $\mu$m or less. Further, the height of the partial glaze from the recording material opposing surface at the conveying direction upstream side of the recording material may be set lower than the height of the partial glaze from the recording material opposing surface at the conveying direction downstream side of the recording material with the heater portion therebetween.

20 Claims, 6 Drawing Sheets

THERMAL HEAD

BACKGROUND OF THE INVENTION

1. Field of the Invention

The present invention relates to a thermal head of a partial-glazed type, and more particularly to a protruding structure of a heater portion on the partial glaze.

2. Description of the Related Art

Conventionally, in order to avoid the accumulation of heat on a head, a resistor (a heater) was provided on a substrate formed by a material which has a large thermal conductivity. As a result, nearly 80% of input energy was radiated, and only 15% or less of heat was able to be contributed to recording. Conversely, in a so-called thermal head of a partial-glazed type in which a resistor was fixed by a fused glass (glaze) having a small thermal conductivity, as compared to a thermal head without a glaze layer, the temperature of the resistor was able to be raised and a large amount of heat was able to be contributed to recording.

As shown in FIG. 6, a partial glaze 1 is provided at the recording material opposing surface S (a lower surface in FIG. 6) side of a thermal head 5 which includes a radiation fin 3. A heater portion is formed at the top surface of the partial glaze 1. In general, radius of curvature of the heater portion is 20 mm, and the height of the partial glaze 1 from the recording material opposing surface S of the thermal head 5 is about 60 $\mu$m. The enlarged view of the partial glaze 1 in FIG. 6 is shown by 1A in FIG. 8A. Additionally, FIG. 6 shows an IC cover 7 and a peel bar 9.

In a thermal printer having such thermal head 5, an unillustrated platen is provided so as to oppose the partial glaze 1, and an unillustrated recording sheet and a toner ribbon are superposed so as to be inserted between the partial glaze 1 and the platen. The portion of the partial glaze 1 corresponding to an image to be printed is selected and heated, and the image is transferred to the recording sheet due to the heat transfer from the toner ribbon.

However, in the aforementioned conventional thermal head 5, heat is transmitted to the recording material as the partial glaze 1 contacts the recording material. Accordingly, when a foreign object is disposed at the recording material, the foreign object moved by the conveyance of the recording material catches on the partial glaze 1, and the portion of the partial glaze 1 on which the foreign object catches does not contact the recording material. Thus, there is a drawback in that heat transfer is not effected on the portion of the recording material at which the foreign object passes and that a void portion (a so-called line void) occurs.

On the other hand, in order to solve the drawback, as shown in FIG. 7, a thermal head, in which the radius of curvature of the heater portion on the partial glaze 1 is 50 mm and the height of the partial glaze 1 is 20 $\mu$m, may be used for reducing the catching of a foreign object. The enlarged view of the partial glaze 1 in FIG. 7 is shown by 1B in FIG. 8A. However, in this case, the radius of curvature of the heater portion is 50 mm and the heater portion is flat. Because the head pressure of the heater portion is reduced, there are drawbacks in that "irregularities" and "roughness" occur and that the image quality is deteriorated.

The drawbacks will be explained in more detail by using FIGS. 8A and 8B. The width of the partial glaze cannot be narrowed so much due to the convenience of a manufacturing process, i.e., if the width of the partial glaze is forcibly narrowed, the height thereof cannot be formed uniformly. Accordingly, as shown in FIG. 8A, the width of the partial glaze is limited to, e.g., 1.5 mm. Therefore, the height of the partial glaze and the radius of curvature of the heater portion formed at the top surface of the partial glaze cannot be changed independently. As shown by C in FIG. 8B, ideally, the height of the partial glaze is 20 $\mu$m while the radius of curvature of the heater portion is kept 20 mm. However, this cannot be effected due to the convenience of the manufacturing process. Therefore, in reality, as shown in FIG. 8A, when the height of the partial glaze is decreased, the radius of curvature of the heater portion is increased.

SUMMARY OF THE INVENTION

The present invention was developed in light of the above circumstances, and the object thereof is to provide a thermal head in which the catching of a foreign object on a partial glaze can be prevented and the head pressure of the partial glaze is not reduced by restricting the actual height of a partial glaze while maintaining the radius of curvature of a heater portion. Accordingly, the image quality is improved by preventing the occurrence of line voids, irregularities and roughness.

For the purpose of achieving the above-described objects, thermal head relating to the present invention comprises a recording material opposing surface which opposes a recording material; a step portion protruding from said recording material opposing surface; a partial glaze whose configuration as viewed from the side is a part of a substantial circle, said partial glaze protruding from said recording material opposing surface, being adjacent to said step portion, and having a height from said step portion of 10 $\mu$m to 40 $\mu$m; and a heater portion formed on said partial glaze and having a radius of curvature of 10 mm to 45 mm.

In the thermal head structured as described above, because the height of the partial glaze from the step portion is 40 $\mu$m or less, whereas, in the conventional structure, the height of the partial glaze from the recording material opposing surface at the upstream side in the conveying direction is 60 $\mu$m, the probability that a foreign object will catch on the partial glaze becomes small. Further, because the radius of curvature of the heater portion is smaller than that of the conventional heater portion of 50 mm, the predetermined amount of head pressure can be maintained per unit of surface area.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

The invention will now be described with reference to the accompanying drawings wherein.

DESCRIPTION OF THE PREFERRED EMBODIMENTS

A thermal head relating to the preferred embodiments of the present invention will be explained hereinafter with reference to the drawings.

Figure 1A:
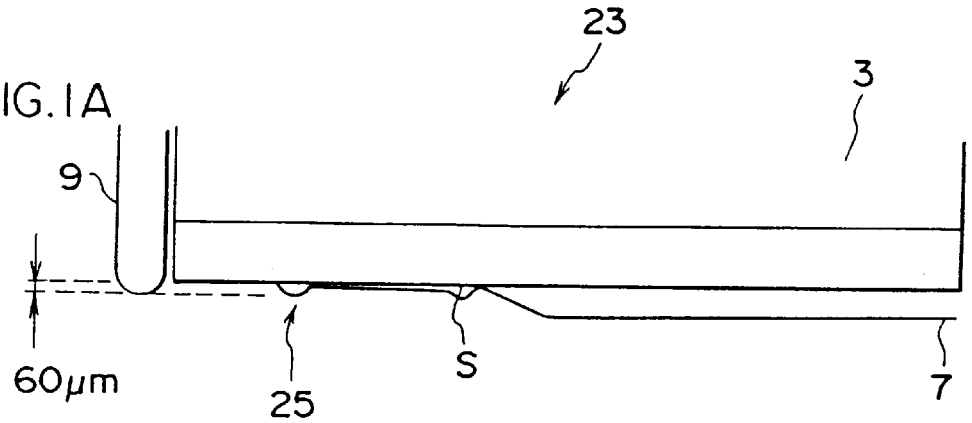
FIG. 1A is a side view which shows a thermal head relating to a first embodiment of the present invention.
Figure 1B:
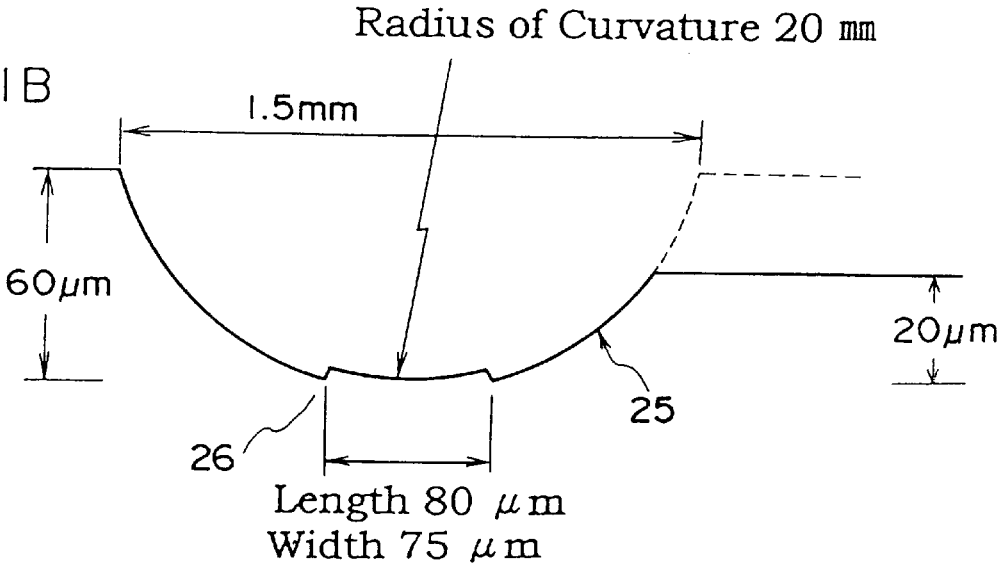
FIG. 1B is an enlarged view of a partial glaze in FIG. 1A.
Figure 2:
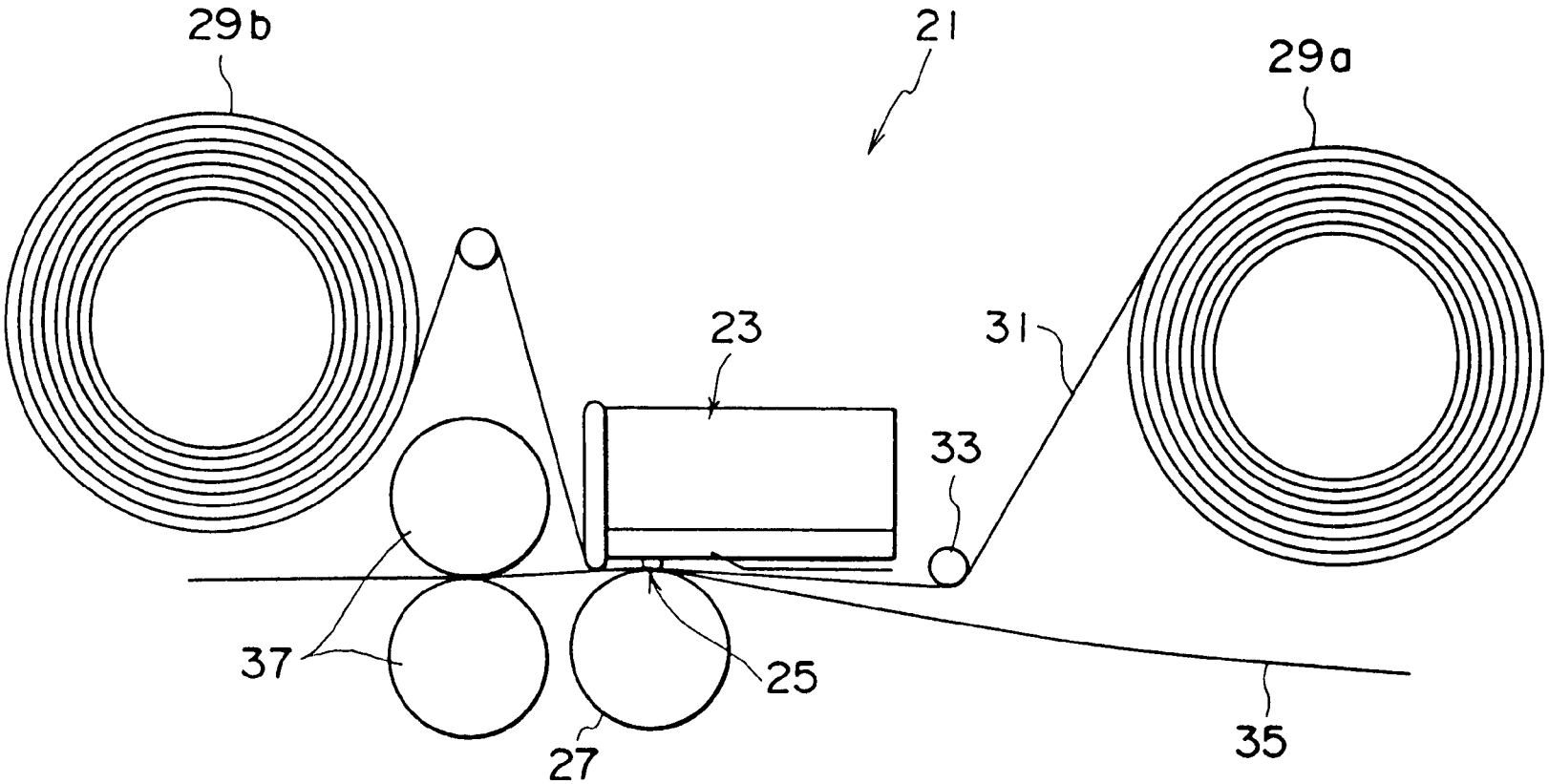
FIG. 2 is a schematic structural view of a principal part of a thermal printer which includes the thermal head in FIG. 1A.
Figure 3A:
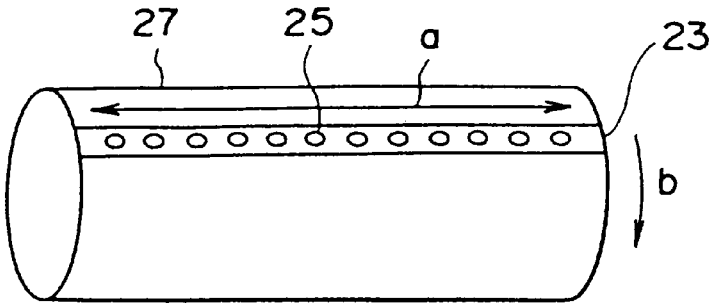
FIGS. 3A and 3B are views which explain a method of operating the thermal head.
Figure 3B:
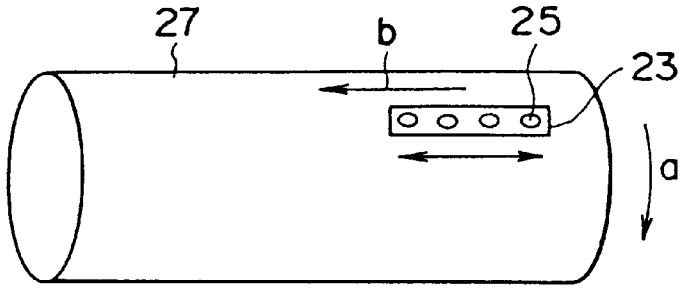
Figure 6:
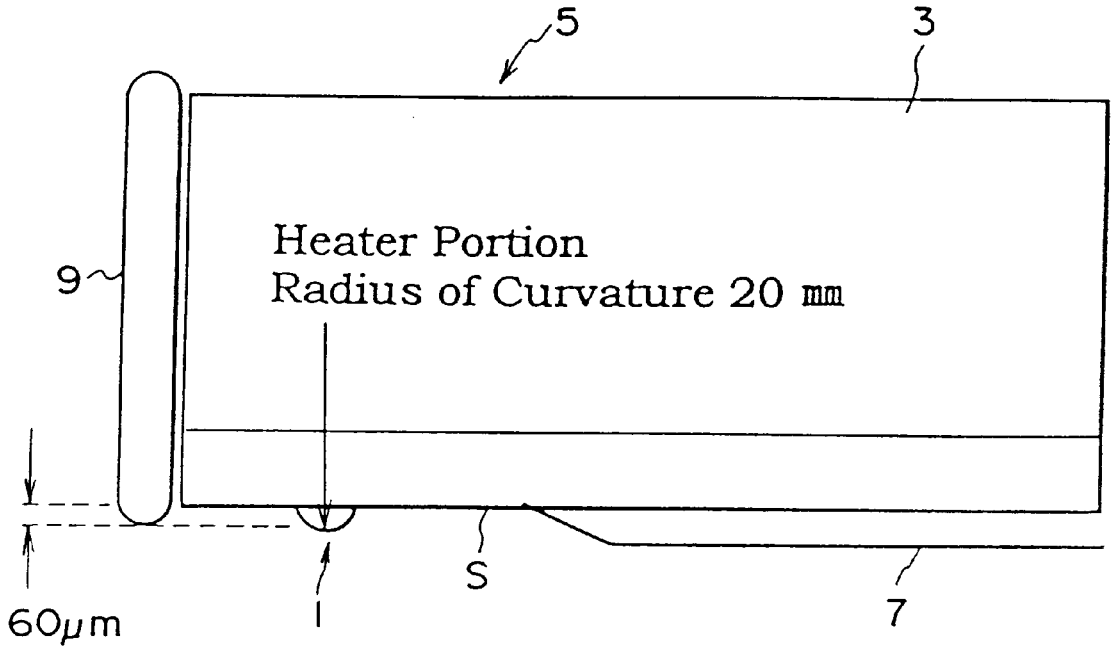
FIG.6 PRIOR ART
FIG. 6 is a side view which shows a structural example of a conventional thermal head.

FIG. 1A is a side view which shows a thermal head relating to a first embodiment of the present invention; FIG. 1B is an enlarged view of a partial glaze in FIG. 1A; FIG. 2 is a schematic structural view of a principal part of a thermal printer which includes the thermal head in FIG. 1A; and FIGS. 3A and 3B are views which explain a method of operating the thermal head. Members which are the same as those in FIG. 6 are denoted by the same reference numerals, and descriptions thereof are omitted.

As shown in FIG. 2, a thermal printer 21 includes a thermal head 23, a platen 27 which opposes a partial glaze 25 of the thermal head 23, a recording material (a toner ribbon) 31 which is nipped between the thermal head 23 and the platen 27 and is wound around a winding side 29*b* from a conveying side 29*a*, a guide roller 33 which guides the conveying side of the toner ribbon 31, and a pair of pinch rollers 37 which is provided at the exit side of the thermal head 23

The thermal head 23 may be a line head type shown in FIG. 3A or a serial head type shown in FIG. 3B. Either of the two can be used. In the line head typed thermal head 23, the partial glazes 25 are provided in line over both ends of the platen 27 in the direction of the rotational central axis of the platen 27. The direction of the rotational central axis of the platen 27 is a main scanning direction "a" of a printing operation, and the rotating direction of the platen 27 is a sub-scanning direction "b" thereof. Further, in the serial head typed thermal head 23, the partial glazes 25 are provided in line over the length shorter than that of the platen 27. The direction of the rotational central axis of the platen 27 is a sub-scanning direction "b" of a printing operation, and the rotating direction of the platen 27 is a main scanning direction "a" thereof. In an embodiment described hereinafter, an example is described of a case in which the thermal head 23 is a line head type.

A guide roller 33 provided at the conveying side 29*a* of the toner ribbon 31 is an adhesive guide roller in which an adhesive layer formed by a rubber material is provided at the outer periphery of a rotational shaft. The guide roller 33 contacts the thermal head opposing surface of the toner ribbon 31 so as to adsorb a foreign object disposed at the toner ribbon 31, and serves as a guide roller which places the toner ribbon 31 at a predetermined conveying path.

As shown in FIGS. 1A and 1B, the height of the partial glaze 25 from a step portion which is disposed at upstream side in a conveying direction of the recording material from the partial glaze 25 is set lower than the height of the partial glaze 25 from the recording material opposing surface S. Namely, the height of the partial glaze is 60 $\mu$m and the radius of curvature of the heater portion is 20 mm, and because the thickness of the step portion is 40 $\mu$m, the height of the partial glaze from the step portion is 20 $\mu$m. In this way, when the height of partial glaze 25 from the step portion is reduced, it is less likely that a foreign object flowing from the upstream side should catch on the partial glaze 25. Moreover, since the radius of curvature of the heater portion 26 remains 20 mm which is the same as the conventional case shown in FIG. 6, the predetermined amount of head pressure per unit of surface area can be maintained.

The length of the heater portion 26 in the conveying direction of the recording material is 80 $\mu$m, and the length of the heater portion 26 in the transverse direction which is orthogonal to the above-described length, i.e., the length thereof which is orthogonal to the page surface of FIG. 1B, is 75 $\mu$m.

As shown in FIG. 1B, for example, an entire surface glaze which has a thickness of 40 $\mu$m is formed, as the step portion, from the position of the partial glaze 25 shown in FIG. 1A to the left-hand side of the position of the IC cover 7. When the entire surface glaze is formed, the end portions thereof tend to rise in general. The heights of the risen portions are set to 60 $\mu$m. As the risen portions are used as the partial glazes, a thermal head of the present application which has desirable partial glazes is formed.

Therefore, in the aforementioned thermal head 23, a foreign object can be prevented from being caught by the partial glaze 25. The head pressure of the heater portion 26 on the partial glaze 25 is not reduced, and the occurrence of line voids, irregularities, and roughness can be prevented.

Figure 4:
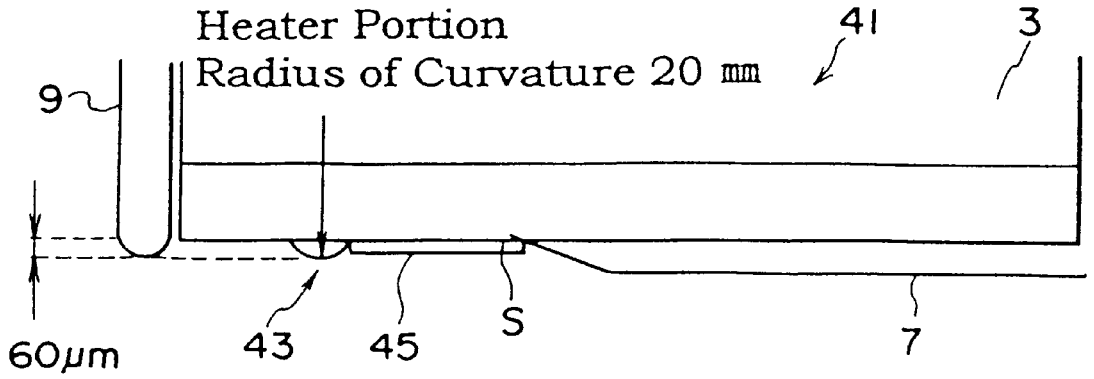
FIG. 4 is a side view which shows a thermal head relating to a second embodiment of the present invention.

Next, a thermal head relating to the second embodiment of the present invention will be explained on the basis of FIG. 4. FIG. 4 is a side view which shows the thermal head relating to the second embodiment of the present invention. In the second embodiment, a heater portion on a partial glaze 43 is provided at the recording material opposing surface S of a thermal head 41, and the radius of curvature of the heater portion is 20 mm and the height of the partial glaze 43 from the recording material opposing surface S is 60 $\mu$m.

On the other hand, between the partial glaze 43 and an IC cover 7, a tape 45 which is provided as the step portion has a thickness of 50 $\mu$m and is formed by, e.g., a polyimide tape or the like, is adhered to the recording material opposing surface S. Accordingly, the heater portion on the partial glaze 43 protrudes 10 $\mu$m from the surface of the tape 45.

In the thermal head 41, as the tape 45 is adhered to the opposing surface S at the conveying direction upstream side of the recording material, the height of the partial glaze 43 at the conveying direction upstream side of the recording material is lower than the height of the partial glaze 43 at the conveying direction downstream side thereof with the heater portion therebetween. Namely, only the protruding height of the partial glaze 43 at the conveying direction upstream side of the recording material is lowered, and the probability that a foreign object will catch on the partial glaze 43 is reduced.

In the thermal head 41, because the protruding height of the partial glaze 43 can be lowered by adhering the tape 45 to the recording material opposing surface S, the catching of a foreign object and the reduction of the head pressure can be prevented as in the same manner as the aforementioned first embodiment. In addition, the partial glaze which has a conventional configuration shown in FIG. 6 (the radius of curvature of the heater portion is 20 mm and the height of the partial glaze is 60 $\mu$m) can be used. Therefore, as compared to the case in which a partial glaze 25 or the like is newly manufactured, the manufacturing cost of the thermal head can be reduced.

Next, the thermal heads 23, 41 according to the aforementioned first and second embodiments were manufactured, conventional structures were compared with regard to the occurring rate of line voids, the remaining rate of line voids, and roughness.

In the guide roller 33, the rotational shaft thereof was formed by stainless steel having ϕ7 mm and the adhesive layer was formed by Mimosa Under LT manufactured by Miyakawa Roller K.K. with a thickness (a thickness after abrasion) of 0.5 mm.

The adhesive strength of the adhesive layer was 10g/cm$^2$ (Measured by a method in accordance with "Test of peeling a sample in which two metal plates in parallel were adhered by a rubber" in the item of JIS K-6301 "Test of adhering a metal and a vulcanized rubber").

Color materials (Y, M, C and K) used by a thermosensitive transfer recording material disclosed in JP-A No. 7-117359 were used for the toner ribbon 31 of the recording material. Namely, 10 g each of four types of dispersion solutions which respectively include the following color materials A through D was prepared, and 0.24 g of amide stearate and 60 g of n-PrOH were added to each of the dispersion solutions so as to form application solutions. Each of the dried thin films A through D was applied to a polyester film (manufactured by Teijin Ltd.) whose reverse surface is peeled and which has a thickness of 5 μm so that the respective thicknesses of the films A through D were 0.36 μm, 0.38 μm, 0.42 μm, and 0.40 μm. Thus, thermosensitive transfer materials were prepared.

| | | | |
|---|---|---|---|
| A: cyan pigment (CI, P. B. 15:4) | 12 g | — | — |
| B: magenta pigment (CI, P. R. 57:1) | — | 12 g | — |
| C: yellow pigment (CP, P. Y. 14) | — | — | 12 g |
| D: carbon (MA-100 manufactured by Mitsubishi Chemical Industries Ltd.) | | | 12 g |
| butyral resin (SLEC FPD-i manufactured by Sekisui Chemical Co., Ltd., softening point: 70° C., average degree of polymerization: 300 or less) | | | 12.0 g |
| solvent n-propyl alcohol | | | 110.4 g |
| dispersing agent Solsperse S-20000 (manufactured by ICI Japan, Co. Ltd.) | | | 0.8 g |

In an image receiving material disclosed in JP-A No. 7-132678, a cushion layer, which has the following composition and has a thickness of 20 μm, is applied to a supporting body, which is formed by Crisper G2323 White PET manufactured by Toyobo Co., Ltd. and has a thickness of 75 μm. Further, an image receiving layer, which has the following composition and has a thickness of 1 μm, is applied to the cushion layer, and thereby, a recording sheet 35 is manufactured. Such recording sheet 35 was used.

| | |
|---|---|
| [Cushion Layer] | |
| polymer ethylene-ethylene acrylate copolymer (Evaflex A-709 manufactured by Mitsui Petrochemical Industries, Ltd.) | 20 parts by weight |
| polymer ethylene-ethylene acrylate copolymer (Evaflex A-709 manufactured by Mitsui Petrochemical Industries, Ltd.) | 20 parts by weight |
| fluorine surfactant (Megafac F177P manufactured by Dainippon Ink & Chemicals, Inc.) | 0.1 parts by weight |
| Solvent | 100 parts by weight |
| [Image Receiving Layer] | |
| nylon | 2 parts by weight |
| butyral | 9 parts by weight |
| fluorine surfactant 10% PrOH | 1.5 parts by weight |

-continued

| | |
|---|---|
| n-propyl alcohol | 58 parts by weight |
| MFG-AC (acetate) | 14 parts by weight |

The occurring rate of line voids was measured by using four colors (KCMY) of ribbons and the recording sheet 35, and four colors of flat nets, each of which is formed by dots and has a net percentage of 40%, were superposed and printed.

This was repeated for 100 sheets, and the number of density lowered portions in which parallels are conspicuous in the sub-scanning direction was counted. The occurring number of line voids was thereby obtained. The occurring rate of line voids was obtained by (occurring number of line voids /100 sheets)×100%.

Further, when the occurred line voids continuously appear on the next print, it was assumed that the line voids remained. The remaining rate of line voids was obtained by (remaining number of line voids / occurring number of line voids)×100%.

Moreover, in order to remove a foreign object between the thermal head 23 or 41 and the guide roller 33, a sequence winding operation, in which the predetermined amount of toner ribbon 31 is rewound, was carried out.

Figure 5A:
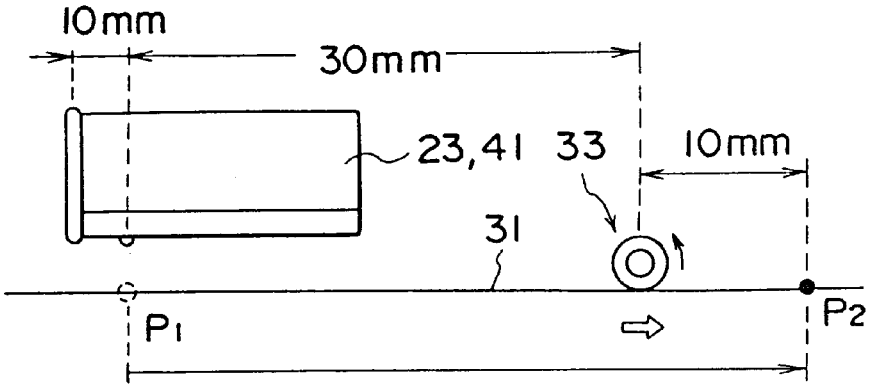
FIGS. 5A through 5C are views which explain the rewinding operation of a toner ribbon.
Figure 5B:
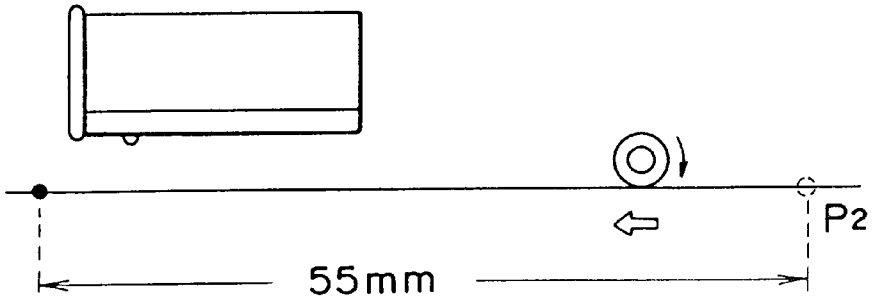
Figure 5C:
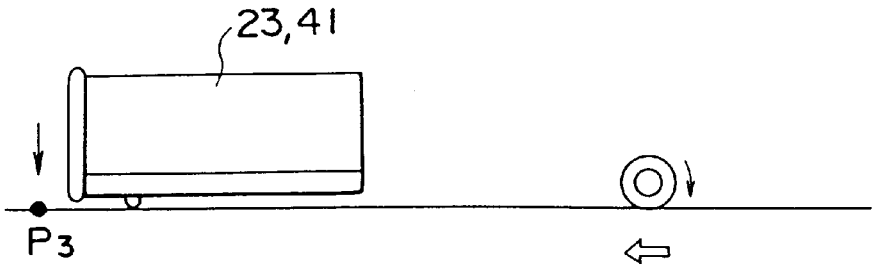

In the rewinding operation, before printing and in a state in which the thermal head 23 or 41 was separated from the platen 27, as shown in FIG. 5A, the portion of the toner ribbon 31 disposed at the position $P_1$ of the thermal head 23 or 41 was rewound around the conveying side 29*a* and conveyed to the position $P_2$ which is beyond the guide roller 33 by 10 mm. Next, as shown in FIG. 5B, the toner ribbon 31 was taken up by 55 mm onto the winding side 29*b* such that the portion of the toner ribbon disposed at the position $P_2$ was conveyed to the position $P_3$. Thereafter, as shown in FIG. 5C, the thermal head 23 or 41 was contacted with the toner ribbon 31, and the toner ribbon 31 and the recording sheet 35 were conveyed at the same velocity. The printing was then started.

Table 1 shows the occurring rate of line voids, the remaining rate of line voids, and roughness which were obtained in accordance with the above conditions.

TABLE 1

| Structure | Adhesive Roller | Sequence (Re-winding) | Occurring Rate of Line Voids | Remaining Rate of Line Voids | Roughness |
|---|---|---|---|---|---|
| Conventional Structure 1 | Not Exist | Exist | 80% | 50% | Not Exist |
| Conventional Structure 1 | Exist | Exist | 5% | 40% | Not Exist |
| Conventional Structure 2 | Exist | Exist | 2% | 0% | Exist |
| First Embodiment | Exist | Exist | 2% | 0% | Not Exist |
| Second Embodiment | Exist | Exist | 2% | 0% | Not Exist |

Figure 7:
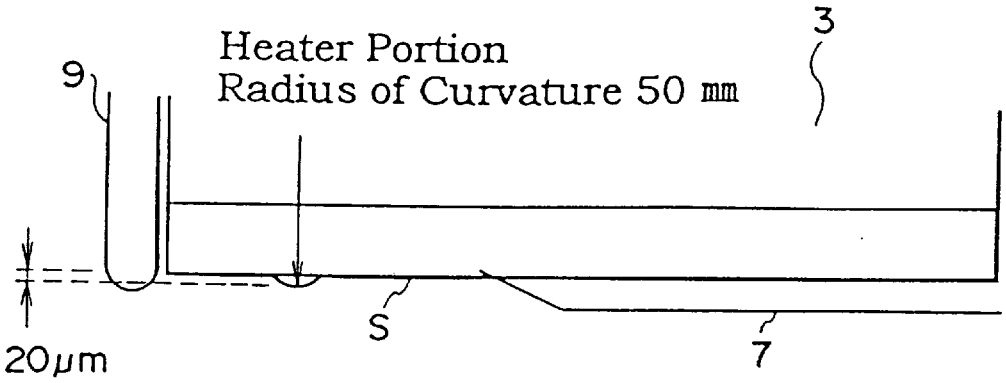
FIG.7 PRIOR ART
FIG. 7 is a side view which shows another structural example of a conventional thermal head.
Figure 8A:
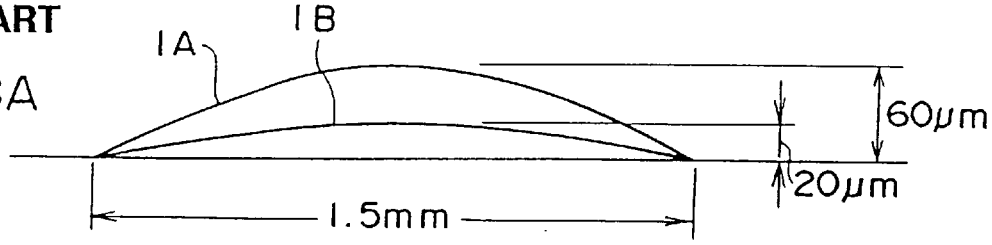
PRIOR ART FIG.8A
FIGS. 8A and 8B are views for explaining conventional drawbacks.
Figure 8B:
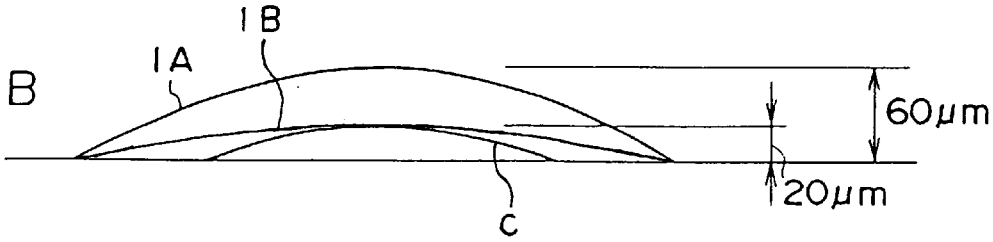

As can be seen from the results shown in Table 1, regarding the thermal printer which includes the guide roller 33 serving as an adhesive roller, in the conventional structure 1 shown in FIG. 6, the occurring rate of line voids was as relatively high as 5% and the remaining rate of line voids was as strikingly high as 40%. Further, in the conventional structure 2 shown in FIG. 7, while the occurring rate of line voids was low and the remaining rate of line voids was 0%, roughness was found.

On the other hand, in each of the thermal heads 23, 41 in accordance with the first and second embodiments shown in FIGS. 1 and 4, the occurring rate of line voids was as low as 2%, the remaining rate of line voids was 0%, and further, roughness was not found. Thus, good image qualities were obtained.

Accordingly, when the radius of curvature of the heater portion on the partial glaze is 50 mm or more and the height of the partial glaze at the upstream side in the conveying direction is 40 μm or more, it is easy that the catching of a foreign object and roughness occur. Conversely, when the radius of curvature of the heater portion on the partial glaze is less than 50 mm (preferably less than 45 mm) and the height of the partial glaze at the upstream side in the conveying direction is less than 40 μm, the catching of a foreign object and roughness do not occur and remarkable effects are obtained.

Moreover, in the experiments of the present invention, the lowest values of the height and the radius of curvature were not taken into consideration. However, from the viewpoint of catching of a foreign object, it is obvious that the lower the height of the partial glaze, the more effective the catching of a foreign object. On the other hand, from the viewpoint of occurring of roughness, it is necessary that a certain amount of height and a certain amount of radius of curvature are maintained so as to obtain a predetermined amount of head pressure. In this case, according to the results obtained from the experiments, good image quality is obtained with the height at the upstream side of the conveying direction being 10 μm (when the tape 45 is used) and with the radius of curvature being 20 mm. Consequently, as the numerical range of the partial glaze in which the manufacturability of the partial glaze is maintained and good image quality is obtained, it is preferable that the height of the partial glaze at the upstream side in the conveying direction is 10 μm to 40 μm and that the radius of curvature of the heater portion is 10 mm to 45 mm.

In the aforementioned first and second embodiments, an example is described of a case in which a line head typed thermal head is applied to the thermal heads 23, 41. However, a serial head typed thermal head can be equally applied to the thermal heads of the present invention.

As described in detail hereinbefore, in accordance with the thermal head relating to the present invention, the height of the partial glaze from the step portion is 40 μm, whereas, in the conventional structure, the height of the partial glaze at the upstream side in the conveying direction is 60 μm and the radius of curvature of the heater portion is less than 50 mm as compared to that of the conventional heater portion of 50 mm. Thus, the probability that a foreign object will catch on the partial glaze is small, and the predetermined amount of head pressure per unit of surface area is maintained. As a result, the occurrence of line voids due to the catching of a foreign object and the occurrence of irregularities and roughness can be avoided. Thereby, the image quality can be improved.

While the embodiments of the present invention, as herein disclosed, constitute a preferred form, it is to be understood that other forms might be adopted.

What is claimed is:

1. A thermal head comprising:

a recording material opposing surface for opposing a recording material;

a step portion protruding from said recording material opposing surface;

a partial glaze (1) protruding from said recording material opposing surface, (2) located adjacent to said step portion, (3) having a height from said step portion of 10 μm to 40 μm, and (4) having a substantially arcuate profile when viewed from a side; and a heater portion formed on said partial glaze and having a radius of curvature of 10 mm to 45 mm.

2. A thermal head according to claim 1, wherein said radius of curvature of said heater portion is 20 mm and said height of said partial glaze from said step portion is 20 μm.

3. A thermal head according to claim 2, wherein said step portion is a glaze.

4. A thermal head according to claim 1, wherein said step portion is a tape adhered to said recording material opposing surface.

5. A thermal head according to claim 4, wherein a height of said partial glaze from said recording material opposing surface is 60 μm.

6. A thermal head according to claim 5, wherein a thickness of said tape is 50 μm.

7. A thermal head according to claim 6, wherein said radius of curvature of said heater portion is 20 mm.

8. A thermal head according to claim 1, wherein said step portion is a glaze.

9. A thermal head according to claim 1, wherein a height of said partial glaze from said recording material opposing surface is 60 μm.

10. A thermal head according to claim 9, wherein said radius of curvature of said heater portion is 20 mm.

11. A thermal printer comprising:

a thermal head having a recording material opposing surface, a step portion, a partial glaze, and a heater portion, said recording material opposing surface for opposing a recording material moving in a conveying direction, said step portion protruding from said recording material opposing surface, said partial glaze (1) protruding from said recording material opposing surface, (2) located adjacent to said step portion so that said step portion is disposed at an upstream side in said conveying direction from said partial glaze, (3) having a height from said step portion of 10 μm to 40 μm, and (4) having a substantially arcuate profile when viewed from a side, and said heater portion being formed on said partial glaze and having a radius of curvature of 10 mm to 45 mm.

12. A thermal printer according to claim 11, wherein said radius of curvature of said heater portion is 20 mm and said height of said partial glaze from said step portion is 20 μm.

13. A thermal printer according to claim 12, wherein said step portion is a glaze.

14. A thermal printer according to claim 11, wherein said step portion is a tape adhered to said recording material opposing surface.

15. A thermal printer according to claim 14, wherein a height of said partial glaze from said recording material opposing surface is 60 μm.

16. A thermal printer according to claim 15, wherein a thickness of said tape is 50 μm.

17. A thermal printer according to claim 16, wherein said radius of curvature of said heater portion is 20 mm.

18. A thermal printer according to claim 11, wherein said step portion is a glaze.

19. A thermal printer according to claim 11, wherein a height of said partial glaze from said recording material opposing surface is 60 μm.

20. A thermal printer according to claim 19, wherein said radius of curvature of said heater portion is 20 mm.

* * * * *